US007654328B2

(12) United States Patent
Stinessen et al.

(10) Patent No.: US 7,654,328 B2
(45) Date of Patent: Feb. 2, 2010

(54) SUBSEA COMPRESSOR MODULE AND A METHOD FOR CONTROLLING THE PRESSURE IN SUCH A SUBSEA COMPRESSOR MODULE

(75) Inventors: Kjell Olav Stinessen, Oslo (NO); Håkon Skofteland, Sandvika (NO)

(73) Assignee: Aker Subsea AS, Fornebu (NO)

( * ) Notice: Subject to any disclaimer, the term of this patent is extended or adjusted under 35 U.S.C. 154(b) by 618 days.

(21) Appl. No.: 10/562,818

(22) PCT Filed: Jul. 1, 2004

(86) PCT No.: PCT/NO2004/000201

§ 371 (c)(1),
(2), (4) Date: Dec. 30, 2005

(87) PCT Pub. No.: WO2005/003512

PCT Pub. Date: Jan. 13, 2005

(65) Prior Publication Data

US 2006/0157251 A1 Jul. 20, 2006

(30) Foreign Application Priority Data

Jul. 2, 2003 (NO) ..... 20033034

(51) Int. Cl.
*E21B 43/36* (2006.01)

(52) U.S. Cl. ..... 166/356; 166/337; 166/344; 166/368; 166/401

(58) Field of Classification Search ..... 166/356, 166/344, 368, 337, 357, 268, 270, 401, 265, 166/266

See application file for complete search history.

(56) References Cited

U.S. PATENT DOCUMENTS

| | | | | |
|---|---|---|---|---|
| 4,969,803 | A * | 11/1990 | Turanskyj | 417/247 |
| 5,312,226 | A * | 5/1994 | Miura et al. | 415/106 |
| 5,382,141 | A * | 1/1995 | Stinessen | 417/423.8 |
| 5,398,762 | A * | 3/1995 | Stinessen | 166/356 |
| 5,417,544 | A * | 5/1995 | Mohn | 415/64 |
| 6,261,070 | B1 * | 7/2001 | Johnson | 417/366 |
| 6,288,510 | B1 | 9/2001 | Toyama | |
| 6,310,414 | B1 * | 10/2001 | Agahi et al. | 310/40.5 |
| 6,464,469 | B1 * | 10/2002 | Grob et al. | 417/251 |

(Continued)

FOREIGN PATENT DOCUMENTS

DE 10005246 C1 10/2001

(Continued)

*Primary Examiner*—Thomas A Beach
*Assistant Examiner*—Matthew R Buck
(74) *Attorney, Agent, or Firm*—Young & Thompson

(57) ABSTRACT

A subsea gas compressor module having a housing comprising a sealing element generally defining within the pressure housing a first compartment holding as compressor and a second compartment holding an electric motor, the compressor and motor being driveably connected by at least one shaft. The first compartment is connected to an inlet line and an outlet line for sealing hydro carbon gas and for discharging gas. The second compartment has magnetic bearings for supporting the at least one shaft, and a pressure and volume regulator is fluidly connected to the second compartment and a gas supply, and includes elements for sensing respective pressures in the inlet and outlet lines whereby, based on the magnitude of sensed pressure, the pressure and volume regulator controls the pressure at which gas is injected into the second compartment.

18 Claims, 3 Drawing Sheets

U.S. PATENT DOCUMENTS

| | | | | |
|---|---|---|---|---|
| 6,601,651 | B2 * | 8/2003 | Grant | 166/370 |
| 7,144,226 | B2 * | 12/2006 | Pugnet et al. | 417/244 |
| 7,244,111 | B2 * | 7/2007 | Suter et al. | 417/423.1 |

FOREIGN PATENT DOCUMENTS

| | | | |
|---|---|---|---|
| EP | 0939228 | A1 | 9/1999 |
| GB | 2298459 | | 9/1996 |
| WO | WO 9117361 | | 11/1991 |
| WO | WO02099286 | | 12/2002 |
| WO | WO 03035225 | | 5/2003 |
| WO | WO03072946 | | 9/2003 |
| WO | WO 2007055589 | A1 * | 5/2007 |

* cited by examiner

SUBSEA COMPRESSOR MODULE AND A METHOD FOR CONTROLLING THE PRESSURE IN SUCH A SUBSEA COMPRESSOR MODULE

The present invention relates to subsea compressor modules for compressing hydrocarbon gases in a wellstream, and more specifically to a subsea compressor module comprising a pressure housing, a compressor and a motor separated by a sealing element.

Subsea compressors which are driven by electric motors, raise problems of keeping the gas-filled electrical motor as dry as possible, in order to avoid corrosion and other problems related to precipitation of hydrocarbon condensates and liquid water inside the motor. It is of particular importance to avoid presence of liquid water together with content of $H_2S$ or $CO_2$ that can form acids and hence accelerated corrosion. These problems are addressed in Norwegian Patents NO 172075 and NO 173197, as well as Norwegian Patent Application 20015199.

Known subsea compressor modules employ regular oil lubricated bearings or similar. The inventor has explored the possibilities of employing magnetic bearings in such subsea compressor modules, as this will have several benefits particularly during operation. Magnetic bearings are more reliable and less expensive to operate. Of particular importance is that application of magnetic bearings eliminates lube oil, and therefore potential problems that can occur by: dilution of the lube oil by the hydrocarbon gases that it is in contact with, accumulation of hydrocarbon condensates or water in the lube oil or degradation of the lube oil over time due to its special application in subsea compressor modules. The problem encountered in employing non-canned magnetic bearings in a subsea compressor module is in many respects similar to those associated with employing electric motors: both need a completely dry atmosphere in order to function properly over time. Canned magnetic bearings also exist or are under development. It is claimed that these can operate in the untreated wellstream hydrocarbon gas. There are, however, reasons to believe that it is advantageous for the long-term functionality and reliability also of this type of magnetic bearings if they are installed and operated in a dry atmosphere.

It is therefore a need for a system and a method for insuring a completely or nearly completely dry environment for the electric motor and for the magnetic bearings.

The present invention meets the abovementioned need, in that it provides a subsea gas compressor module having a pressure housing, which comprises an electric motor and a compressor, driveably connected by at least one shaft, said compressor and motor being mutually isolated by at least one seal, thereby dividing said pressure housing into a first and a second compartment comprising the compressor and motor respectively. The subsea gas compressor according to the invention is characterised in that said at least one shaft is supported by magnetic bearings, controlled by a control unit, wherein said bearings are placed inside the pressure housing of the compressor module. The electronics and electric components of the magnetic bearings are placed inside a separate pressure housing close to the compressor module. This pressure housing is filled by an inert gas, typically nitrogen, or an inert liquid, and have an inside pressure in the range of one bar, or in the range that the electronic components can tolerate. There are a significant number of wires between the housing for the magnetic bearing electronics and the compressor module housing. These wires supplies the magnetic bearings with a controlled magnetization current, as well as transmits signals from sensors of the magnetic bearings to the control electronics in the pressure housing for the magnetic bearings electronics. Special penetrators through the walls of the pressure housings prevent ingress of seawater. The wires between the pressure housing of the electronics and the compressor module can either be connected with subsea mateable connectors, or can be connected dry.

The subsea gas compressor according to the invention is furthermore comprising a sealing element, generally defining within said pressure housing a first compartment holding a compressor, and a second compartment holding an electric motor, said compressor and motor being driveably connected by at least one shaft; said first compartment being connected to an inlet line and an outlet line for receiving gas and discharging gas, respectively; said inlet and outlet lines comprising respective valves for closing said lines. The subsea gas compressor according to the invention is characterised by magnetic bearings in said compartments for supporting said at least one shaft; a pressure and volume regulator fluidly connected to said second compartment and to a gas supply of dry hydrocarbon or inert gas (extraneous gas) and comprising means for sensing respective pressures in said inlet and outlet lines, whereby, based on the magnitude of said sensed pressure, the pressure and volume regulator control the pressure at which gas from said supply is injected into said second compartment.

The invention also comprises a method for controlling the pressure in a subsea compressor module, when the compressor is running, as described above said method being characterised by:

a) compressing a wellstream gas being fed at a suction pressure into said compressor and said first compartment;
b) discharging said gas from the first compartment at a discharge pressure;
c) sensing said suction and discharge pressures respectively;
d) injecting a dry or inert gas from a supply into said second compartment at an injection pressure, wherein said injection pressure is greater than said suction pressure and whereby fluid flow directly from said first compartment and into said second compartment is prevented.

The invention comprises a method for controlling the pressure in the subsea compressor module as described above, when said compressor is inactive and valves 7 and 9 are closed and 8 is open, and the method is characterised by:

a) sensing a suction pressure in a suction line upstream of said first compartment,
b) sensing a discharge pressure in a discharge line downstream of said first compartment,
c) injecting a dry or inert gas from a supply into said second compartment at an injection pressure, wherein said injection pressure is greater than said suction pressure or said discharge pressure, whichever is the higher one, and whereby fluid flow directly from said first compartment and into said second compartment is prevented and ingress of wet gas and liquid from the natural gas line 11 into the compressor module is also prevented.

An embodiment of the present invention will now be described in more detail, with reference to the accompanying drawings, where like parts have been given like reference numbers.

Figure 1:
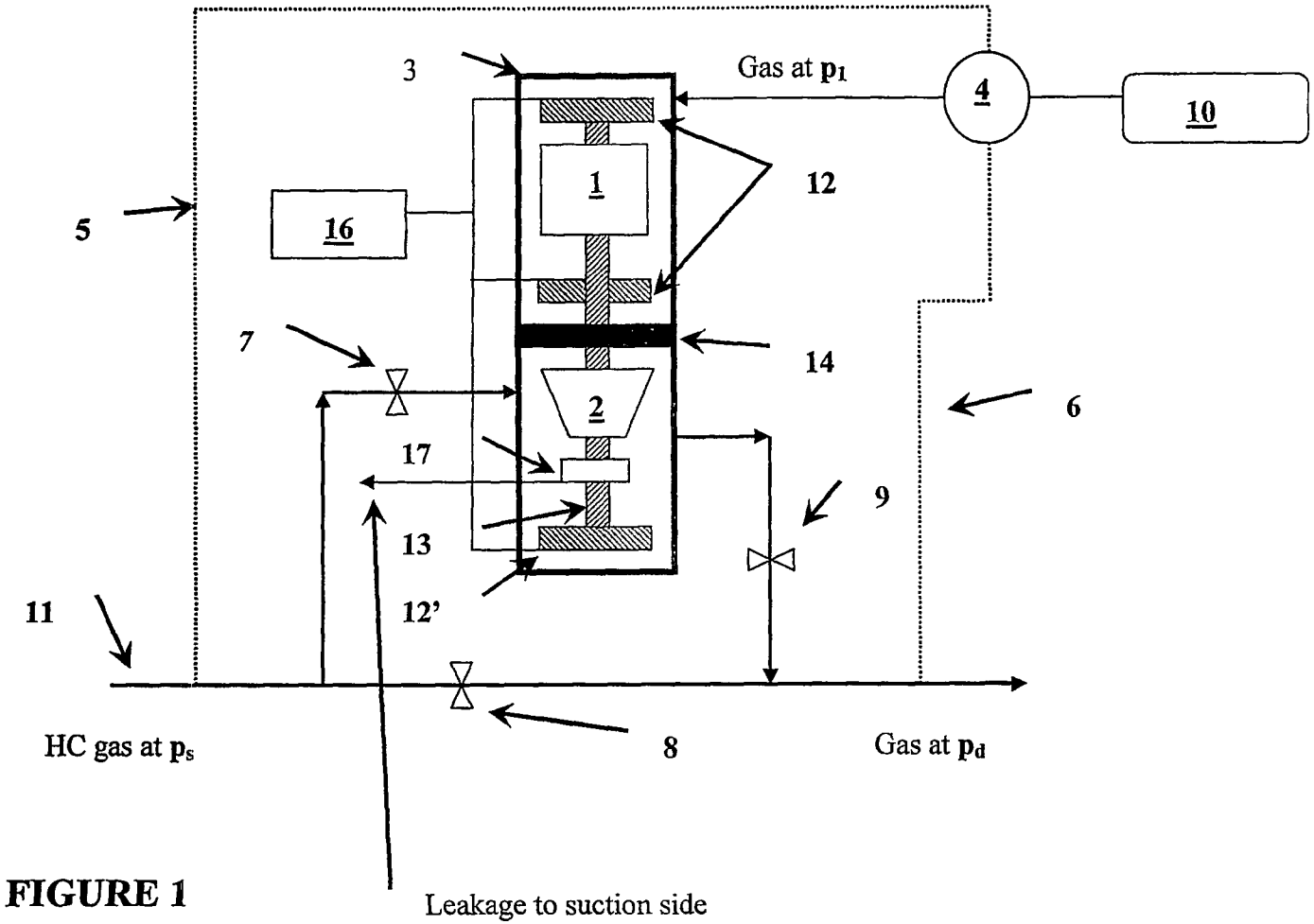
FIG. 1 is a schematic of an embodiment the system according to the invention.

Referring now to the drawings, in particular FIG. 1, a schematic of the system according to the invention is disclosed. A pressure housing 3 contains an electric motor 1, which is connected to a compressor 2 by means of one or more shafts 13. Both the motor and the compressor are equipped with magnetic bearings. Six bearings are necessary if the shaft 13 is coupled by a flexible coupling between the shaft of the compressor and the motor, i.e. one thrust bearing and two radial bearings in each unit, while only three bearings will be sufficient if the shaft 13 is a single shaft or the shafts of the compressor and motor are coupled by a stiff coupling, i.e. one thrust bearing and two radial bearings for the whole compressor module. The pressure housing internal cavity is divided essentially into two compartments by means of a sealing element 14. This sealing element, or shaft seal, is commonly known in the art. The seal 14 thus essentially divides the internal volume of the pressure housing into a first compartment holding the compressor 2 with magnetic bearings 12', and a second compartment holding the electric motor 1 with magnetic bearings 12. The necessary electronic components for controlling and monitoring the magnetic bearings are symbolised by reference numeral 16, which indicate a unit being connected to the magnetic bearings.

Hydrocarbon (wellstream) gas at a suction pressure ($p_s$) is fed into the first compartment via the line 11. The gas is being discharged from the compressor at a discharge pressure ($p_d$) when the valve 9 is open during operation. During operation, when the compressor 2 is compressing the wellstream gas, valve 8 is closed, while valves 7 and 9 are open. Hydrocarbon gas is thus flowed and compressed in a regular fashion. As mentioned previously, it is of great importance that the second compartment, holding the motor 1, comprises a dry and corrosion free environment. A gas line is therefore connected to a gas supply 10 for injecting gas from this supply into the second compartment. This injection of gas at $p_1$ into the second compartment is facilitated by the pressure and volume regulator 4. The pressure and volume regulator 4 controls the injection pressure based on the sensed suction and discharge pressures through sensing lines 5 and 6 respectively. In order to prevent hydrocarbon gas from ingressing from the first compartment and into the second compartment during operation, the pressure and volume regulator ensures that $p_1$ always is greater than the suction pressure. During a shut-down or inactive situation, valves 7 and 9 are closed off, while valve 8 is open. In certain transient states, the discharge pressure may be less than the suction pressure. Hence, the pressure and volume regulator 4 must adjust the injection gas pressure ($p_1$) such that the injection gas pressure is greater that the suction pressure or the discharge pressure, which ever is the higher. Because the valves 7 and 9 are closed when the compressor is not operating, the pressure inside the whole module 3 will be equalised to the injection pressure ($p_1$), and hence is prevented ingress of wet gas or liquids from the line 11 into the compressor module 3 which in particular protects the motor and the bearings.

Figure 2:
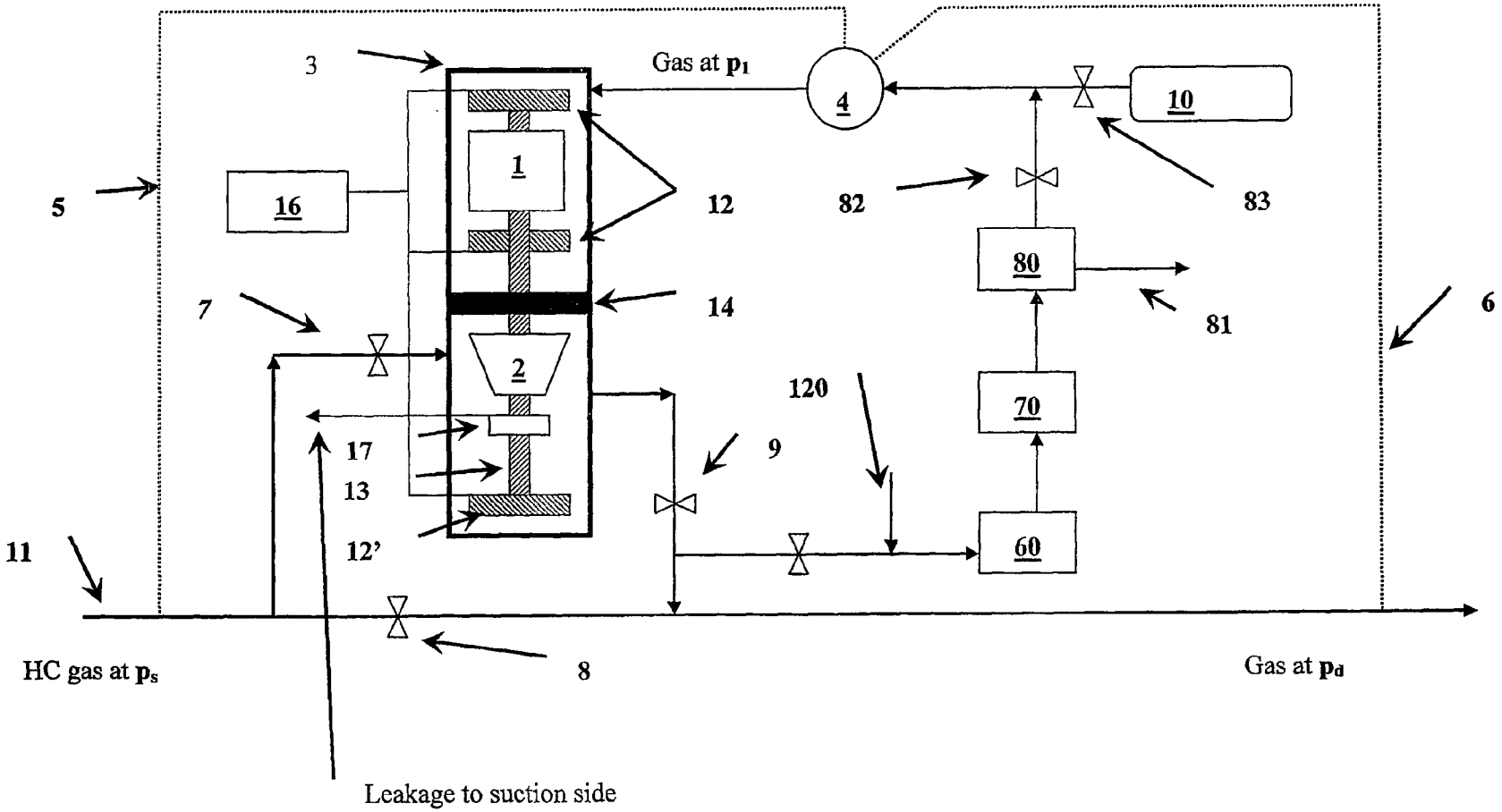
FIG. 2 is a schematic of a second embodiment of the system according to the invention.

FIG. 2 discloses in principle the same system as FIG. 1, but the system now has an alternative source of dry injection gas. In FIG. 2, the inert gas from the supply 10 may, when the compressor is running, be replaced by hydrocarbon gas extracted from the compressor outlet or from an intermediate stage, cooled in the heat exchanger 60, choked in a Joule-Thomson valve 70 prior to entering a scrubber 80. This system and method is disclosed in the Norwegian Patent Application 20015199. In this configuration valve 83 is shut off while valve 82 is open when the compressor is running. Reference numeral 81 identifies a conventional scrubber discharge line that typically feeds the collected liquid that also may contain particles, back to the suction side, while reference numeral 120 indicates an injection line for a hydrate inhibitor (optional).

When the compressor is shut down or inactive, valve 82 is closed, while valve 83 is open, and the injection gas is from reservoir 10 and injection pressure $p_1$ controlled as earlier described. Valves 7 and 9 are closed and valve 8 is open.

An optional method for keeping the dew point of the injection gas below sea temperature during operation, is to mix the hydrocarbon gas extracted from the compressor outlet or an intermediate stage with a fraction of gas from 10, sufficient to keep the dew point below sea water temperature. Hence the valve 70 can be eliminated, and also the cooler 60 and the scrubber 80.

Figure 3:
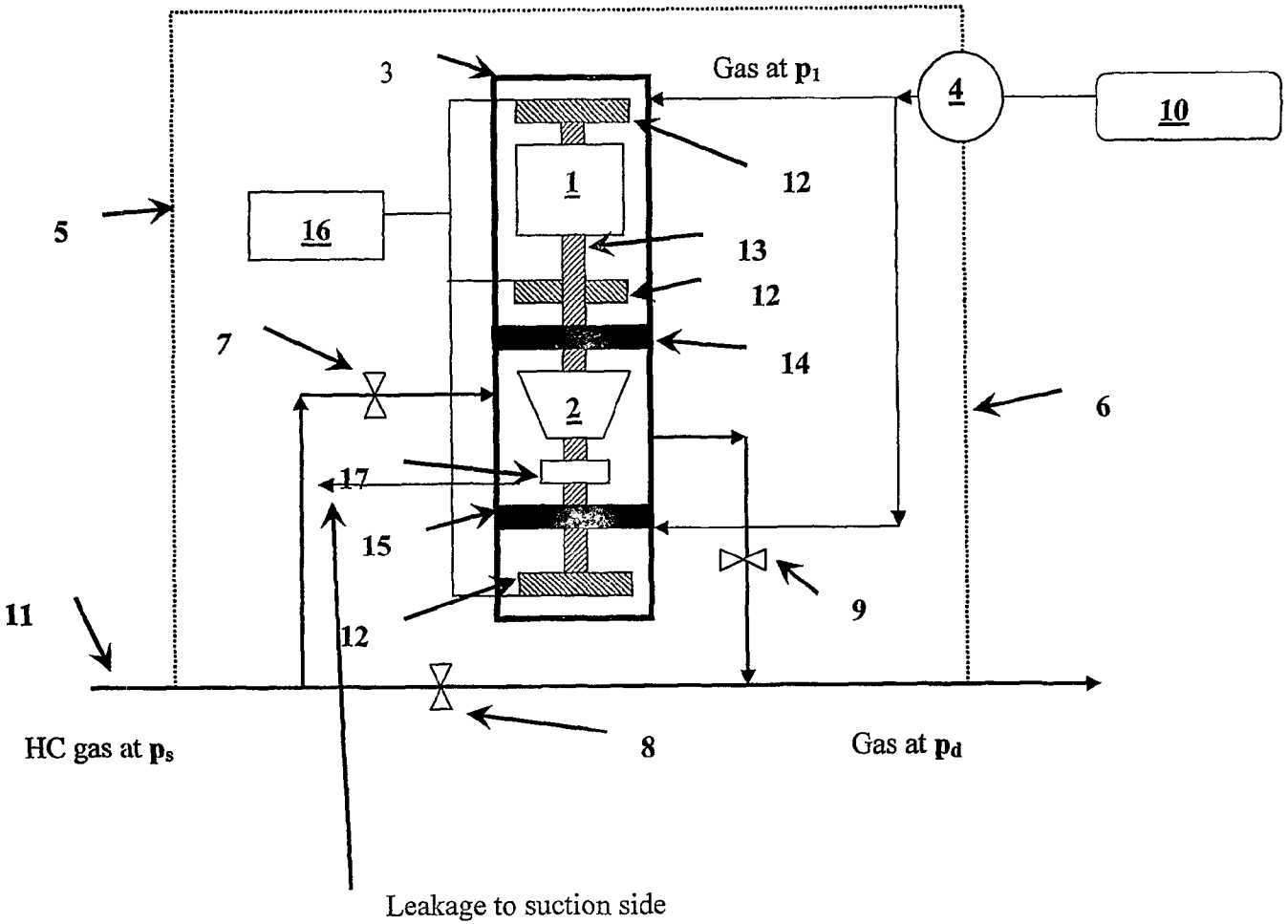
FIG. 3 is a schematic of a further embodiment of the system according to the invention.

FIG. 3 is another embodiment of the invention as disclosed in FIG. 1, where the first compartment essentially has been subdivided into a further compartment, the compressor is still in a first compartment while a third compartment, now defined by the shaft seal 15, holds a magnetic bearing 12, which is also being subjected to injection gas at $p_1$.

As has been described above, the motor and compressor may be connected via one or more shafts 13 (e.g. a single shaft or coupled shafts). Both the motor 1 and compressor 2 are equipped with magnetic bearings 12. In the case of a coupled shaft, six bearings are necessary, i.e. one thrust bearing and two radial bearings for each unit. With a single shaft, or a stiff coupling between the shaft of the motor and the shaft of the compressor, three bearings are sufficient, i.e. one thrust bearing and two radial bearings for the whole compressor module.

The shaft seal 14 divides the pressure housing 3 into two compartments:

(i) a first compartment enclosing the compressor 2, and (ii) a second compartment comprising the motor 1 and (optionally) a coupling housing.

The compressor module may also be equipped with a compressor shaft seal 15 at the shaft end opposite to the motor side, thus forming a third compartment.

The magnetic bearings of the compressor 2 may be placed in the first compartment if they are of the canned type, in which case compartment three is superfluous, or if it is judged favourable to have them in a dry atmosphere, they are placed in compartments two and three.

The second (and optionally the third) compartment is pressurized by a gas at $p_1$, in order to prevent ingress of hydrocarbon gases from the first compartment. The gas pressurized at $p_1$ may be an inert gas from the reservoir 10 or (e.g.) a dried hydrocarbon gas extracted from the compressor outlet or an intermediate stage, heat exchanged against a cooling medium (e.g. seawater) in the heat exchanger 60 and chocked prior to entering the scrubber 80, in accordance with the equipment and process described in Norwegian patent application 20015199. Optionally the gas pressurised at $p_1$ may be a mix of both gases as described above.

In operation, the compressor 2 generates a suction pressure ($p_s$) and a discharge pressure ($p_d$). Discharge pressures typically lie in the region $P_d$=70 bar to 150 bar, and the suction pressure typically in the region 40 bar to 140 bar.

In operation, valves 7 and 9 are open, while valve 8 is closed off, and $p_d > p_s$. In order to prevent gas ingress into the second (and optional the third) compartment, the second compartment pressure must exceed the suction pressure, i.e.: $p_1 > p_s$.

This is achieved by the pressure and volume regulator 4, sensing $p_s$ through line 5 and adjusting $p_1$ accordingly.

At shutdown and inactive situations, valves 7 and 9 are closed off, while valve 8 is open. In certain transient states, $p_d < p_s$. Hence, the regulator 4 must adjust the inert gas pressure such that $p_1 > p_s$ or $p_1 > p_d$, whichever is the higher. In such cases the pressure inside the whole module 3 (first, second and (optionally) third compartment) will be equal ($p_1$), which prevents leakages of wet gas from the natural gas lines 11 upstream and downstream of the compressor into the module.

When the compressor module is installed in a compressor station according to Norwegian Patent Application 20034055, the protection of the compressor motor and magnetic bearings (second and (optionally) third compartment) against condensed water and hydrocarbons can be significantly simplified. In this case there is in principle no need for injection of inert or dry hydrocarbon gas when the compressor is in operation, because the atmosphere in the compressor module and antisurge recycle line will be completely dry during operation. Injection is therefore only needed when the compressor is shut down and inactive. However, as a safeguard against condensation, a small injection flow of (e.g. extraneous) gas is continuously supplied during operation.

| | |
|---|---|
| 1 | Electric motor |
| 2 | Compressor |
| 3 | Pressure housing |
| 4 | Pressure and volume regulator |
| 5 | Pressure sensing line, suction side |
| 6 | Pressure sensing line, discharge side |
| 7 | Compressor inlet valve |
| 8 | Shut-off valve |
| 9 | Compressor outlet valve |
| 10 | Inert gas supply |
| 11 | Natural gas inlet line |
| 12, 12' | Magnetic bearing |
| 13 | Shaft |
| 14 | Shaft seal |
| 15 | Shaft seal |
| 16 | Magnetic bearing control unit |
| 17 | Balance drum |
| 60 | Heat exchanger |
| 70 | Choke valve |
| 80 | Scrubber |
| 81 | Discharge line |
| 82 | Shut-off valve |
| 83 | Shut-off valve |
| 120 | Hydrate inhibitor injection |

The invention claimed is:

1. A subsea gas compressor module having a pressure housing (3) comprising:

an electric motor (1) and a compressor (2), drivably connected by at least one shaft (13);

said at least one shaft being supported by a plurality of magnetic bearings (12) controlled by a control unit (16);

said control unit being placed externally of said pressure housing, and connected to said magnetic bearings by means of wire connections or subsea mateable connectors;

said compressor and motor being mutually isolated by at least one seal (14), thereby dividing said pressure housing (3) into a first and a second compartment comprising the compressor and motor, respectively;

said first compartment being connected to an inlet line (11) and an outlet line for receiving gas and discharging gas, respectively;

said inlet and outlet lines comprising respective valves (7,9) for closing said lines;

said second compartment comprising at least two of said magnetic bearings for supporting said at least one shaft;

said first compartment being subdivided into a third compartment by means of another sealing element (15), comprising one of said magnetic bearings for supporting said at least one shaft; and a pressure and volume regulator (4) fluidly connected to said second compartment and to a supply (10) of gas and comprising means for sensing respective pressures in said inlet and outlet lines; wherein, based on the magnitude of said sensed pressure, the pressure and volume regulator controls the pressure at which gas from said supply is injected into said second compartment.

2. The gas compressor module of claim 1, wherein said pressure housing is oriented vertically.

3. The gas compressor module of claim 1, wherein said motor is placed above said compressor, wherein said second compartment is located above said first compartment.

4. The gas compressor module of claim 1, wherein said pressure and volume regulator also is connected to said third compartment, whereby, based on the magnitude of said sensed pressure, the pressure and volume regulator controls the pressure at which gas from said supply is injected into said third compartment.

5. The gas compressor module of claim 1, wherein said sealing elements (14,15) are shaft seals associated with said shaft (13).

6. The gas compressor module of claim 1, wherein said gas supply (10) is an inert gas supply, whereby inert gas is injected into said second compartment.

7. The gas compressor module of claim 1, wherein said gas supply is a well stream, and hydrocarbon gas is extracted from the compressor outlet or an intermediate stage, passed through a heat exchanger (60), a choke valve (70), a scrubber (80), whereby dried hydrocarbon gas is injected into said second compartment.

8. The gas compressor module of claim 1, wherein the hydrocarbon gas extracted from the compressor outlet or an intermediate stage is mixed with a fraction of inert gas, in order to keep the dew point below that of the cooling medium.

9. The gas compressor module of claim 1, wherein said fluid is composed of a mix of inert gas and hydrocarbon gas, with a proportion of inert gas to make the dew point of the mix suitable to avoid condensation, preferably below sea water temperature at all modes of operation or shutdown.

10. A method for controlling the pressure in a subsea compressor module according to claim 1, comprising:

a) compressing a well stream gas being fed at a suction pressure ($p_s$) into said compressor (2) in said first compartment; and b) discharging said gas from the first compartment at a discharge pressure ($p_d$) characterized by:

c) sensing (4,5) said suction pressure, and d) injecting a dry or inert (extraneous) gas from a supply (10; 11) into said second compartment at an injection pressure ($p_1$), wherein said injection pressure is greater than said suction pressure and whereby fluid flow directly from said first compartment and into said second compartment is prevented.

11. A method for controlling the pressure in a subsea compressor module according to claim 1, when said compressor (2) is inactive and valves 7 and 9 are closed, comprising:

a) sensing (4,5) a suction pressure ($p_s$) upstream of said first compartment;

b) sensing (4,6) a discharge pressure ($p_d$) downstream of said first compartment;

c) injecting a dry or inert gas from a supply (10; 11) into said second compartment at an injection pressure ($p_1$), wherein said injection pressure is greater than said suction pressure and said discharge pressure, and whereby fluid flow directly from said first compartment and into said second compartment is prevented and ingress of wet gas and liquids from the natural gas line 11 into the compressor module 3 is also prevented.

12. The method of claim 10, wherein said dry or inert gas is injected at an injection pressure into a third compartment defined by a sealing element (15).

13. The method of claim 10, wherein said gas supply (10) is an inert gas supply, whereby inert gas is injected into said second compartment.

14. The method of claim 10, wherein said gas supply (11) is a well stream, and hydrocarbon gas is extracted from the compressor outlet or an intermediate stage, passed through a heat exchanger (60), a choke valve (70), a scrubber (80), whereby dried hydrocarbon gas is injected into said second compartment.

15. The method of claim 10, wherein said dry or inert gas is injected at an injection pressure into a third compartment defined by a sealing element (15).

16. The method of claim 10, wherein said gas supply (10) is an inert gas supply, whereby inert gas is injected into said second compartment.

17. The method of claim 10, wherein said gas supply (11) is a well stream, and hydrocarbon gas is extracted from the compressor outlet or an intermediate stage, passed through a heat exchanger (60), a choke valve (70), a scrubber (80), whereby dried hydrocarbon gas is injected into said second compartment.

18. The method of claim 10, further comprising sensing (4, 6) said discharge pressure prior to step d).

* * * * *

UNITED STATES PATENT AND TRADEMARK OFFICE

CERTIFICATE OF CORRECTION

PATENT NO. : 7,654,328 B2
APPLICATION NO. : 10/562818
DATED : February 2, 2010
INVENTOR(S) : Stinessen et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 856 days.

Signed and Sealed this

Twenty-eighth Day of December, 2010

David J. Kappos

David J. Kappos
*Director of the United States Patent and Trademark Office*